United States Patent [19]

Taya

[11] Patent Number: 4,675,622

[45] Date of Patent: Jun. 23, 1987

[54] COAXIAL CABLE INCLUDING AN INDUCTION CABLE

[76] Inventor: Keiichiro Taya, 2-1, Takiyama,2-Chome, Higashikurume-shi, Tokyo, Japan

[21] Appl. No.: 729,579

[22] Filed: May 2, 1985

[30] Foreign Application Priority Data

May 2, 1984 [JP] Japan ..... 59-89141

[51] Int. Cl.[4] ..... H01P 5/00

[52] U.S. Cl. ..... 333/24 R; 333/115; 333/245

[58] Field of Search ..... 333/115, 24 R, 236, 333/243, 245

[56] References Cited

U.S. PATENT DOCUMENTS

| | | | |
|---|---|---|---|
| 2,925,565 | 2/1960 | Cook et al. | 333/115 X |
| 3,324,417 | 6/1967 | Garner | 333/24 R X |
| 4,157,518 | 6/1979 | McCarthy | 333/236 X |

FOREIGN PATENT DOCUMENTS

| | | | |
|---|---|---|---|
| 1146559 | 4/1963 | Fed. Rep. of Germany | 333/115 |
| 50-24436 | 8/1975 | Japan . | |
| 58-82415 | 5/1983 | Japan . | |

*Primary Examiner*—Paul Gensler

*Attorney, Agent, or Firm*—Finnegan, Henderson, Farabow, Garrett & Dunner

[57] ABSTRACT

Coaxial cable having an induction cable helically wound around a carrier cable.

3 Claims, 21 Drawing Figures

FIG. 1
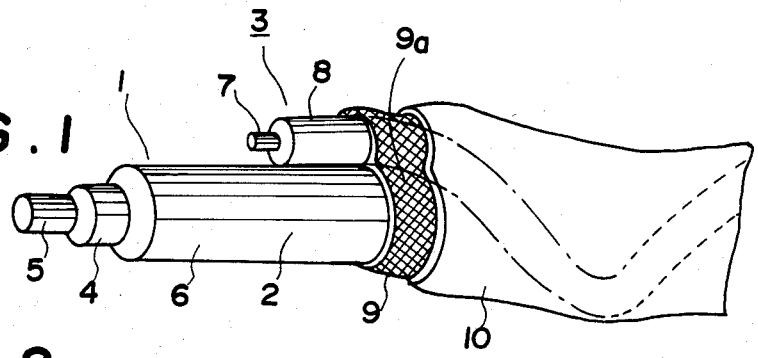
FIG. 2
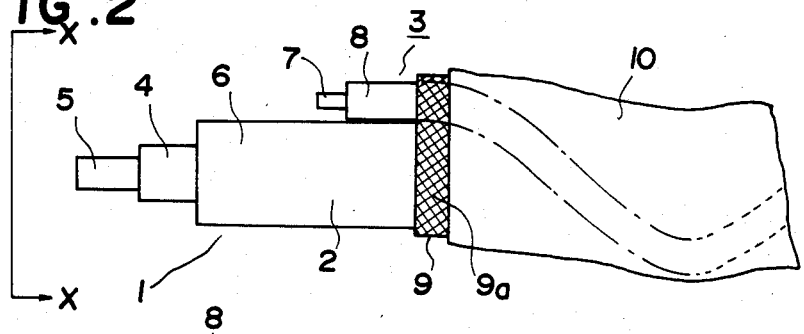
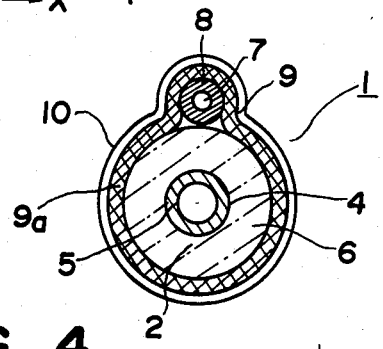
FIG. 3
FIG. 4
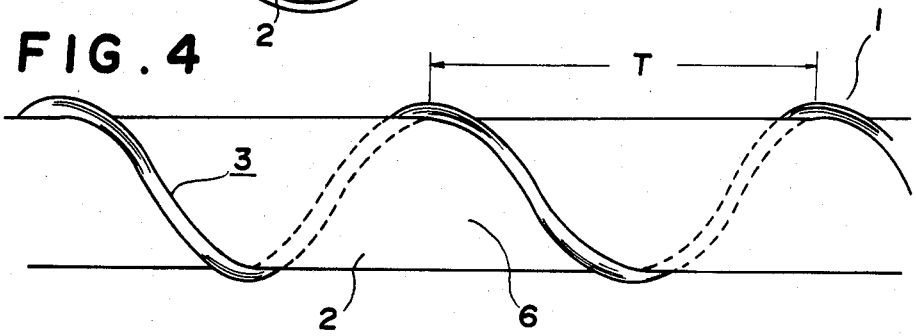

FIG. 19
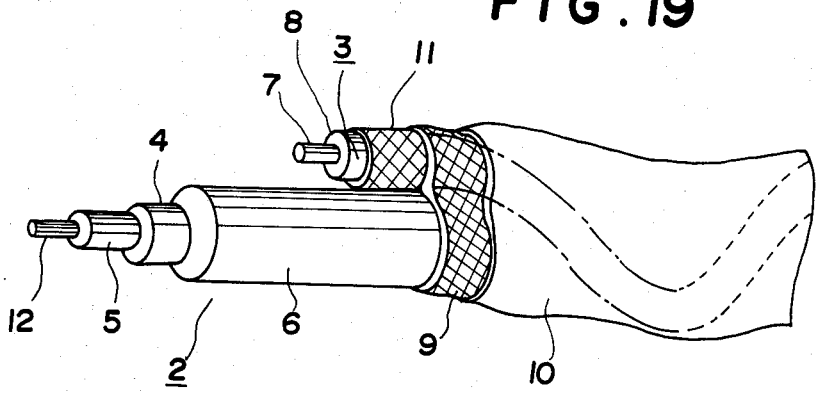
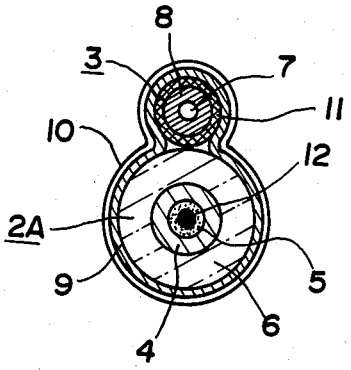
FIG. 20
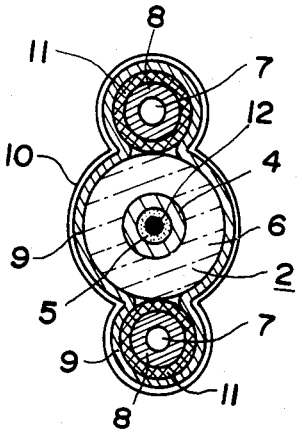
FIG. 21

COAXIAL CABLE INCLUDING AN INDUCTION CABLE

BACKGROUND OF THE INVENTION

This invention relates to an improvement in a coaxial cable including an induction cable.

Prior cables of this type are described in published Japanese patent applications TOTUKOV SMO 50-24436 as well as TOTUKAI SMO 58-82415, in which an induction cable is simply laid lengthwise or parallel with a carrier cable and wrapped in a common sheath. The simple parallel alignment between the two cables, however, can cause dielectric polarization from electrostatic charges which alter the dielectric constants of the dielectric substances in the cable. Also physical pressure on the coaxial cable causes piezoelectric induction in these dielectric substances. This polarization and induction prevent stable induced outputs from the induction cable.

SUMMARY OF THE INVENTION

It is an object of the present invention to eliminate these problems in coaxial cables including an induction cable by providing a coaxial cable comprising a carrier cable and an induction cable in which the induction cable is helically wound around the carrier cable.

An advantage of the invention is that by helically winding the induction cable at a certain period on the carrier cable there is a close electric and magnetic coupling between the carrier cable and its induction cable, which permits a higher output voltage to be obtained from the induction cable.

Another advantage is that the helical winding of the induction cable on the carrier cable considerably reduces the alteration of the dielectric substances' dielectric constant which is caused by electric charge induced by the helical winding, thereby allowing more stable output voltages to be obtained.

A further advantage of helically winding the induction cable around the carrier cable is a reduction of the piezoelectric voltage induced on the surface of the coaxial cable due to the physical pressure created by said helical winding, thereby also allowing more stable outputs to be obtained.

Another advantage is that the conductive substance of the carrier cable behaves like a pipe-like conductor or a conductive sheath, because high-frequency current flows substantially only on the surface of the substance on account of the skin effect. Therefore, a solid substance or a solid sheath is not necessary, which saves material and costs.

BRIEF DESCRIPTION OF THE DRAWINGS

FIG. 1 is a perspective view of a first embodiment of a coaxial cable of my invention;

FIG. 2 is a right side view of the cable of FIG. 1;

FIG. 3 is a sectional view taken along the line X—X of FIG. 2;

FIG. 4 shows the period of the helically wound induction cable of the coaxial cable of FIGS. 1–3;

FIG. 19 is a perspective view of an eighth embodiment of a coaxial cable of my invention;

FIG. 20 is a sectional view of the cable of FIG. 19; and

FIG. 21 is an offset sectional view of the cable of FIG. 19 showing the helically wound induction cable at two spaced locations.

DETAILED DESCRIPTION OF THE INVENTION

Figure 5:
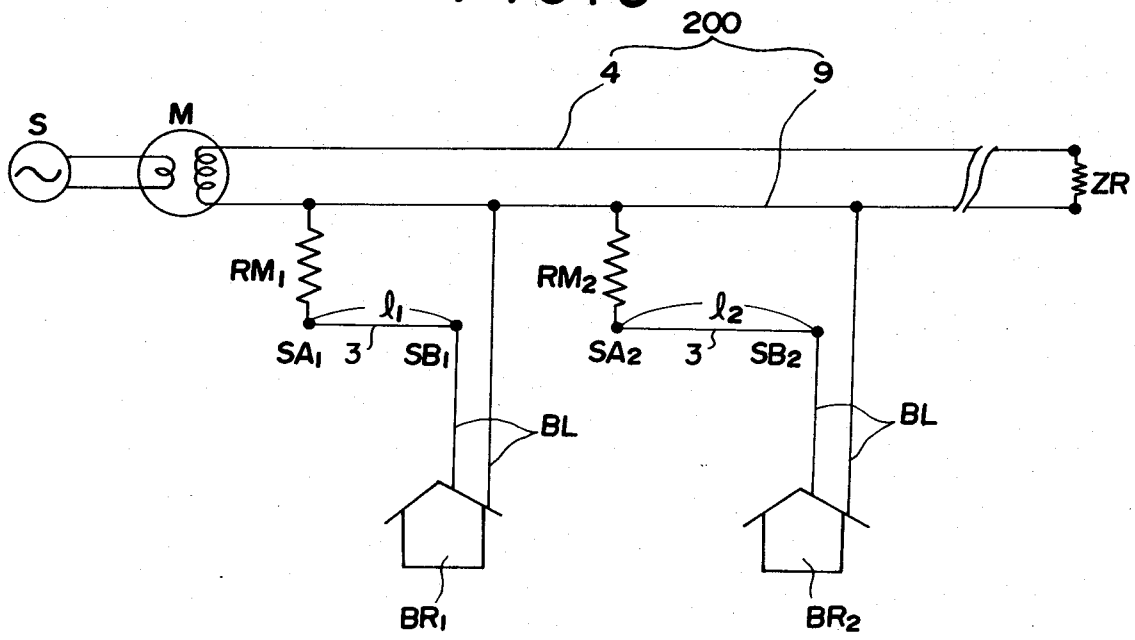
FIG. 5 is a schematic diagram showing a method of using the cable of FIG. 1.

The invention will be further described with reference to the drawings wherein like elements in the different embodiments are given the same reference number.

Referring to FIGS. 1–5, there is shown a coaxial cable 1 including an induction cable constructed according to the invention, which includes a carrier cable 2 and an induction cable 3.

Carrier cable 2 has a pipe-like, center-conductor 4, which is filled with an inner insulator 5, such as polyethylene, and has an outer insulator 6, such as foamed polyethylene, Teflon, etc. Induction cable 3 has an induction wire 7 at its center and is covered with an insulator 8 of foamed polyethylene, Teflon, etc. In accordance with the invention, induction cable 3 is helically wound at a certain period T around the outer surface of carrier cable 2 as best shown in FIG. 4.

An outer conductor 9 covers carrier cable 2 and helically wound induction cable 3. Outer conductor 9 can be a finely woven sheath 9*a* (FIGS. 1–3) or of laminated aluminum 9*b*. (FIG. 9) The density $\rho$ of finely woven sheath 9*a* is around 70% or more. Finally, the coaxial cable includes an outer sheath or cover 10 made of polyethylene or the like.

As is well known, the voltage induced in induction cable 3 is a result of the magnetic and electric field produced by the carrier cable 2.

Referring to FIG. 5, which illustrates an embodiment of using the cable of this invention just described, S is a signal source, and M provides for matching the resistor ZR to the impedance Z of the coaxial cable 200, which includes the carrier center-conductor 4, the insulator 6, and the outer conductor 9. $RM_1$ and $RM_2$ are matching resistors. To obtain branched outputs for subscribers such as BR1, BR2, etc., the induction center-conductor 7 of the induction cable 3 is cut at a length $l_1$ of 2.5 to 5 meters for one branch BR1 and the two ends are labeled SA1 and SB1. Subscriber BR1 receives its signals by connecting the subscriber's coaxial cable BL at SB1 and to the outer conductor 9 of coaxial cable 200 as shown in FIG. 5. At subscriber BR2, the same connection can be established using a length $l_2$ of cable 3 which can be different, preferably lonzger than $l_1$. The reason for making $l_2$ longer is that there is a power loss in coaxial cable 200 as it extends towards the resistor ZR, but, it is desirable to supply the electric power at the same level to both connecting subscribers BR1, BR2. Thus, the length $l_2$ of the induction cable 3 is made longer to increase the induction output. In a preferred embodiment, if the span of 2.5 meters is doubled to 5 meters in $l_2$, then an increase in branch-output amplitude of around 6 dB will be obtained.

Objects of the present invention are not only to increase the induced output of the coaxial cable by having the induction cable 3 helically wound on the carrier cable 2, but also to eliminate the piezoelectric effect induced in the dielectric substance subjected to physical pressure applied to the coaxial cable by the tight physical contact of the induction cable with the carrier cable.

Figure 6:
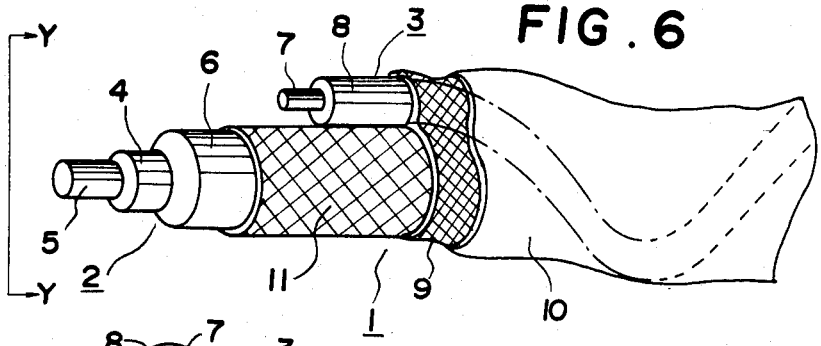
FIG. 6 is perspective view of a second embodiment of a coaxial cable of my invention.
Figure 7:
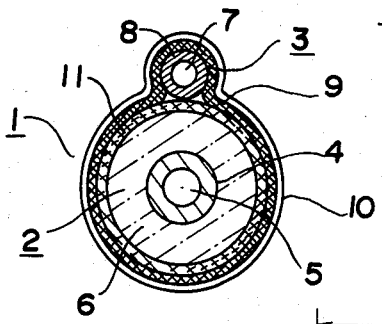
FIG. 7 is a sectional view taken along the line Y—Y of FIG. 6.
Figure 8:
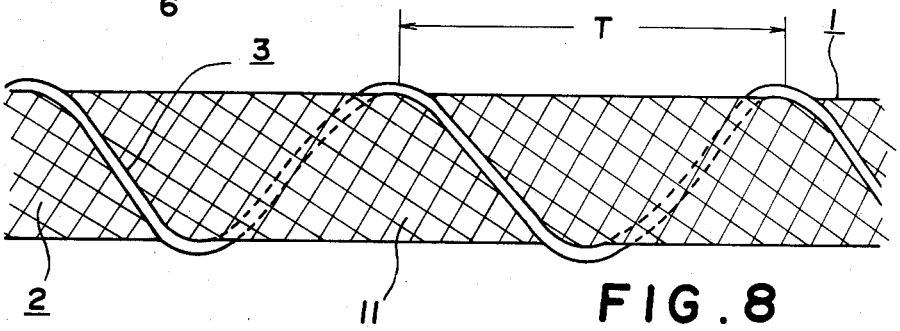
FIG. 8 shows the period of the helically wound induction cable of the coaxial cable of FIG. 6.

Referring to FIGS. 6–8, a second embodiment of tne invention will now be described. This embodiment provides a shield of a coarse net of metal 11 on the outer surface of carrier cable 2 as described above, having a density of 70% or less. The density $\rho$ of the net is defined as $$\rho = b/(a+b) \times 100\%$$

where a is the area of vacant space and b is that area occupied by the wire of the net.

In the present invention, the density $\rho$ of the net is 70% or more for a fine net 9*a* and is 70% or less for a coarse net 11.

The output signals are induced in the induction center-conductor 7 by the magnetic and the electric field of the carrier center-conductor 4 which have leaked through the coarse net 11. Therefore, the induced output depends on the density $\rho$ of the coarse net 11.

Figure 9:
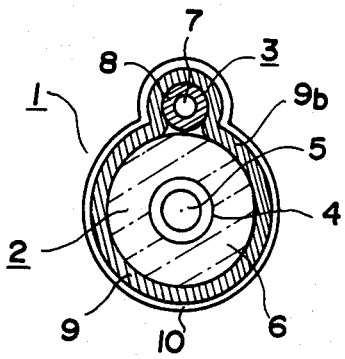
FIG. 9 is a sectional view of a third embodiment of a coaxial cable of my invention.
Figure 10:
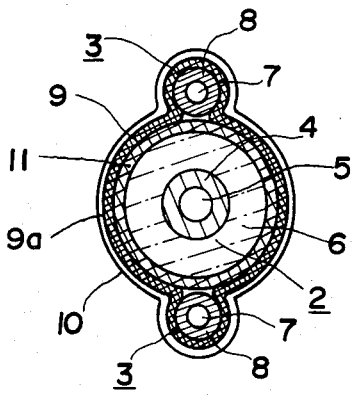
FIG. 10 is a sectional view of a fourth embodiment of a coaxial cable of my invention.
Figure 11:
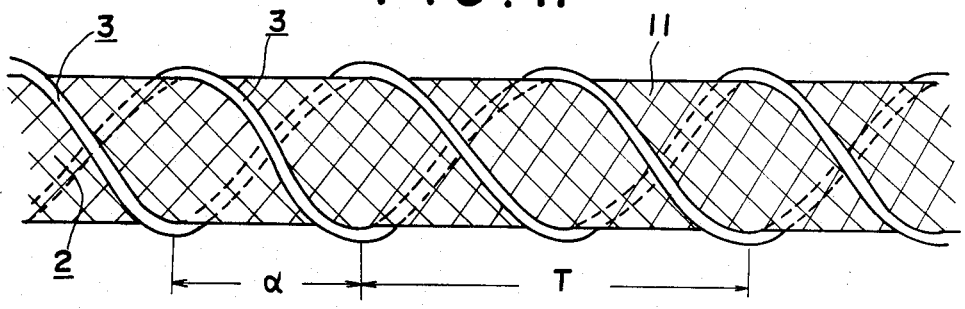
FIG. 11 shows the period of the two helically wound induction cables of the coaxial cable of FIG. 10.
Figure 13:
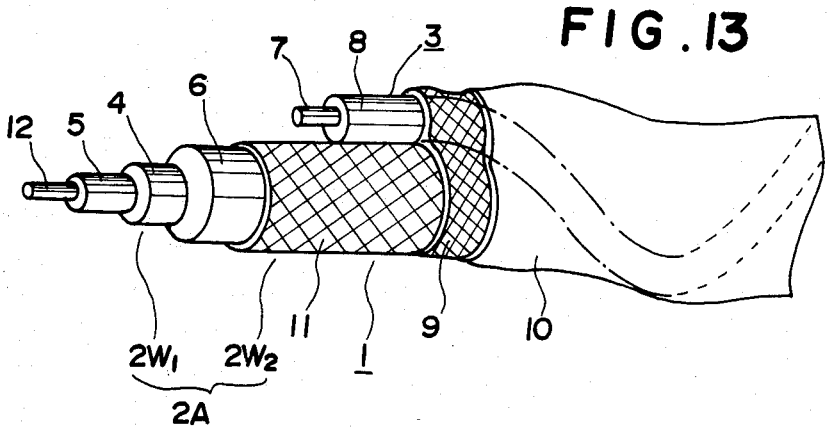
FIG. 13 is a perspective view of a sixth embodiment of a coaxial cable of my invention.

Referring to FIG. 9, a third embodiment will be described. This embodiment provides an outer conductor 9 of laminated aluminum 9*b* which covers carrier cable 2 and induction cable 3 that is helically and tightly wound at a period T on carrier cable 2. The advantage of this embodiment is the same as that utilizing metal net 11. Referring to FIGS. 10 and 11, this embodiment increases the branch output amplitude by helically winding a plurality of induction cables, two cables being shown in FIG. 11, at a certain period T on the outer surface of a carrier cable 2 covered by a coarse net 11.

Figure 12:
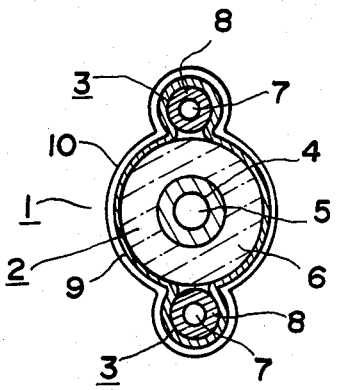
FIG. 12 is a sectional view of a fifth embodiment of a coaxial cable of my invention.

Referring to FIG. 12, this embodiment has a carrier cable 2 and two induction cables 3 covered by an outer conductor 9, the two induction cables being helically wound at a certain angle $\alpha$ in phase and at a certain period T on the carrier cable 2 as shown in FIG. 11. The advantage of this embodiment is same as the embodiment of FIG. 10.

Figure 17:
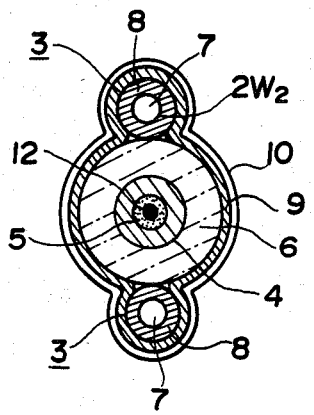
FIG. 17 is a sectional view of a seventh embodiment of my invention.
Figure 14:
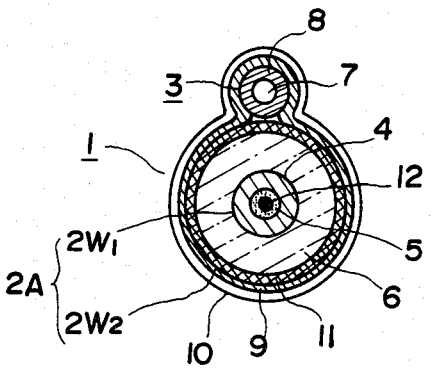
FIG. 14 is a sectional view of the cable of FIG. 13.
Figure 15:
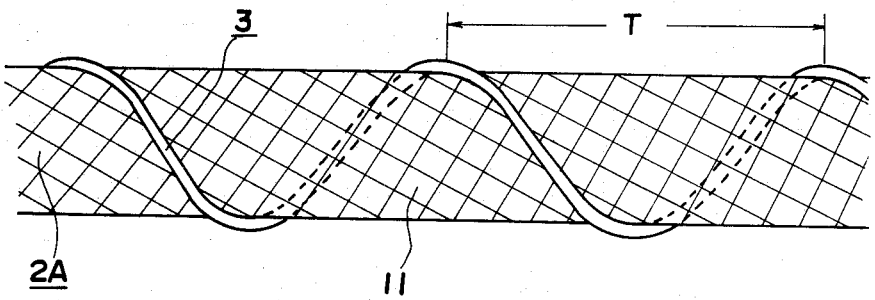
FIG. 15 shows the period of the helically induction cable of the cable of FIG. 13.
Figure 18:
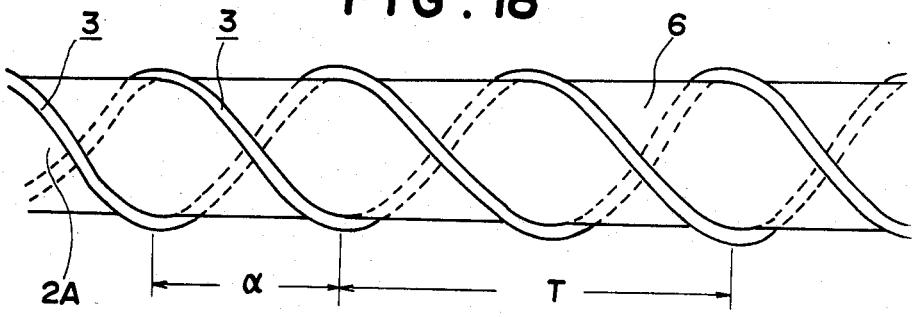
FIG. 18 shows the periods of the two helically wound induction cables of the coaxial cable of FIG. 17.
Figure 16:
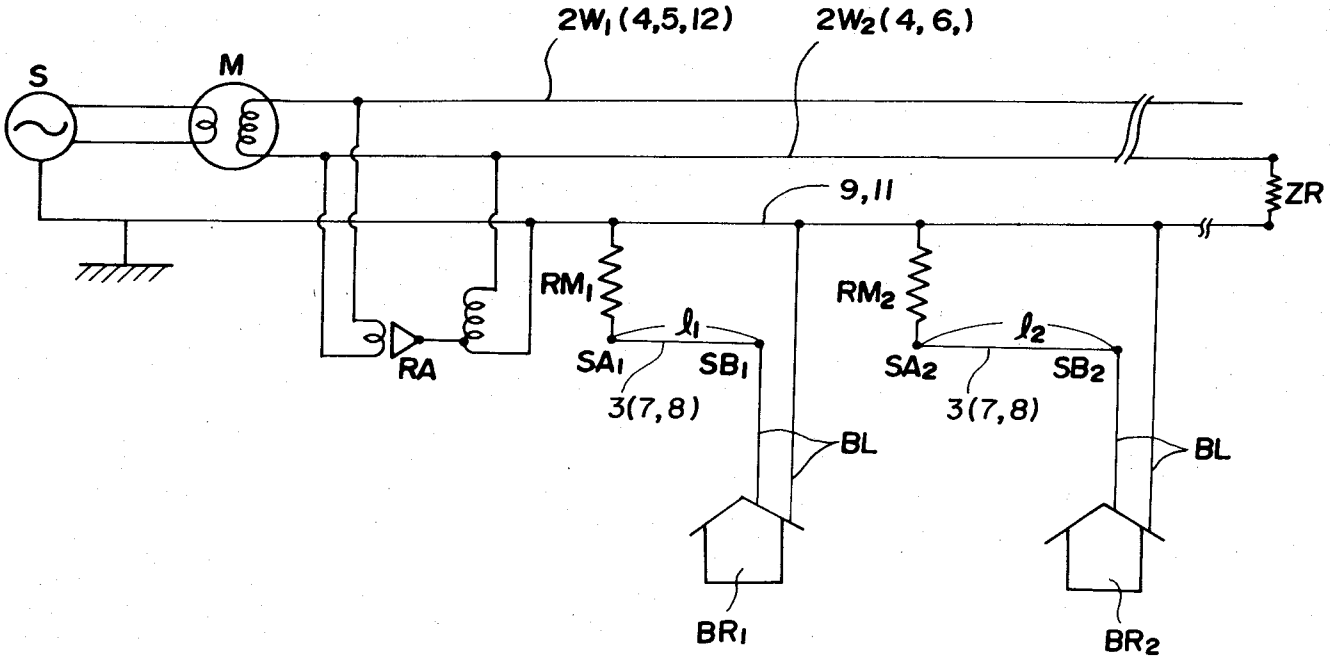
FIG. 16 is a schematic diagram showing a method of using the cable of FIG. 13.

Referring to FIGS. 13–16, this embodiment illustrates the winding of the induction cable 3 and a coarse net 11 around a double coaxial carrier-cable 2A wherein an inner wire-like carrier center-conductor 12 is located in pipe-shaped carrier center-conductor 4 and separated therefrom by an insulator 5. Thus the double coaxial carrier-cable 2A includes a carrier cable 2W1, comprising inner carrier center-conductor 12, insulator 5 as the dielectric substance and outer pipe-like carrier center-conductor 4, and another carrier cable 2W2, comprising carrier center-conductor 4 and insulator 6 as the dielectric substance. This cable can be used as shown in FIG. 16 where the carrier cables 2W1 and 2W2 may be used for independent objects without any connection with each other. In the embodiment, carrier cable 2W1 can serve for transmission of a program source PS (not shown) in high quality as a trunk line, the program source PS being fed to the repeater RA, the output of which is fed to another carrier cable 2W2, and the branched output of the induction cable 3 is fed to the subscribers (BR1, BR2, . . .). Referring to FIGS. 17 and 18, in this embodiment the fine net as outer conductor 9 covers induction cables 3 and the insulator 6, the two induction cables being helically wound on the outer surface of the insulator 6 around the carrier center-conductor 4 at a certain angle $\alpha$ in phase and at a certain period T.

Referring to FIGS. 19–21, in this embodiment coarse net 11 covers only induction cable 3, which provides low loss in the induction cable, even if the span is long.

By the present invention, the induced output of the induction cable is increased and stabilized by reducing the effect of the magnetic and electric field.

What is claimed is:

1. A coaxial cable comprising a carrier cable, an induction cable helically wound onto the carrier cable, a layer of conductive material of a coarse net of metal surrounding and covering said induction cable and between and in contact with said induction cable and said carrier cable and an external conductor layer covering said induction cable and said carrier cable.

2. The coaxial cable of claim 1 further including a plurality of induction cables wound at a preset angle in phase.

3. The coaxial cable of claim 1 wherein said carrier cable is a two-layered, coaxial carrier cable.

* * * * *